US007430388B2

(12) United States Patent
Zona et al.

(10) Patent No.: US 7,430,388 B2
(45) Date of Patent: Sep. 30, 2008

(54) PIN ARRAY SCOROTRON CHARGING SYSTEM FOR SMALL DIAMETER PRINTER PHOTORECEPTORS

(75) Inventors: Michael F. Zona, Holley, NY (US); Dan A. Hays, Fairport, NY (US); Kenneth W. Pietrowski, Penfield, NY (US)

(73) Assignee: Xerox Corporation, Norwalk, CT (US)

( * ) Notice: Subject to any disclaimer, the term of this patent is extended or adjusted under 35 U.S.C. 154(b) by 299 days.

(21) Appl. No.: 11/327,585

(22) Filed: Jan. 6, 2006

(65) Prior Publication Data

US 2007/0160389 A1 Jul. 12, 2007

(51) Int. Cl.
*G03G 15/02* (2006.01)

(52) U.S. Cl. ..... 399/171; 399/173

(58) Field of Classification Search ..... 399/50, 399/168, 171, 173; 361/225, 229; 250/325
See application file for complete search history.

(56) References Cited

U.S. PATENT DOCUMENTS 4,507,373 A * 3/1985 Tsilibes ..... 430/31
4,725,732 A 2/1988 Lang et al.
5,206,784 A 4/1993 Kimiwada et al.
5,530,526 A 6/1996 Kleckner et al.
5,574,541 A * 11/1996 Folkins ..... 399/171
5,581,331 A * 12/1996 Teshigawara et al. ..... 399/171
5,781,829 A * 7/1998 Wong et al. ..... 399/91
5,991,579 A * 11/1999 Yu ..... 399/170
6,459,873 B1 10/2002 Song et al.
6,553,198 B1 4/2003 Slattery et al.
6,823,157 B2 11/2004 Foltz
6,963,708 B2 * 11/2005 Sekovski et al. ..... 399/171
7,031,628 B2 * 4/2006 Sekovski et al. ..... 399/50
7,149,458 B2 12/2006 Zona et al.
2005/0135825 A1 6/2005 Sekobski et al.
2006/0245789 A1 * 11/2006 Zona ..... 399/171

FOREIGN PATENT DOCUMENTS

JP 10208847 A * 8/1998

* cited by examiner

*Primary Examiner*—Robert Beatty
(74) *Attorney, Agent, or Firm*—Fay Sharpe LLP

(57) ABSTRACT

Non-contact corona charging of a small radius moving surface to a desired surface voltage with a single corona charging system with a first corona generator applying a first charge through a screen grid having a first bias voltage to initially charge the surface to more than half of the desired voltage, and then a second corona generator applies the remainder of the desired surface charge through a separate screen grid having a second bias voltage. The two corona generators may be spaced pin arrays angled relative to one another and substantially perpendicular to their adjacent moving surface areas. The two screen grids may be electrically planar and angled relative to one another, substantially parallel to their adjacent moving surface areas.

1 Claim, 2 Drawing Sheets

PIN ARRAY SCOROTRON CHARGING SYSTEM FOR SMALL DIAMETER PRINTER PHOTORECEPTORS

Cross-referenced [NOT PRIORITY CLAIMED] is a commonly assigned U.S. application Ser. No. 10/891,319 filed Jul. 14, 2004 by John S. Facci, et al., entitled XEROGRAPHIC CHARGING DEVICE HAVING TWO PIN ARRAYS, now U.S. Pat. No. 7,110,701 B2 which issued Sep. 19, 2006; and also another commonly assigned U.S. application Ser. No. 11/068,357 filed Feb. 28, 2005 by Michael F. Zona, et al., entitled XEROGRAPHIC CHARGING DEVICE HAVING THREE PIN ARRAYS, now U.S. Pat. No. 7,149,458 B2 which issued Dec. 12, 2006.

Disclosed in the embodiments herein is an improved corona charging system which is particularly suitable for, but not limited to, a compact configuration of components for the surface charging of small diameter drums such as xerographic imaging or image transfer drums, directly, or onto belts as they are being partially wrapped around small diameter drums.

Noted by way of incorporated by reference background on what are some known pin (aka saw tooth) electrical corona discharge arrays in what are also well known in the xerographic art as corotrons or scorotrons (the latter having corona discharge screen control grids and (typically) side shields) are: Xerox Corporation USPTO published application No. 2005/0135825 A1, published Jun. 23, 2005 by David Sekovski, et al, entitled "Systems and Method For Setting Up Grid Voltages In A Tandem Pin Charging Device" Xerox Corp. U.S. Pat. No. 4,725,732 issued Feb. 16, 1988 to Joseph H. Lang, et al; and U.S. Pat. No. 6,459,873 B1 issued Oct. 1, 2002 to Jing Qing Song, et al.

Furthermore, Xerox Corporation U.S. Pat. No. 6,823,157 B2 issued Nov. 23, 2004 discloses a corona wire (non saw tooth) scorotron with a single piece mesh grid having a curvature generally corresponding to the curvature of the drum surface being charged. NexPress Solutions LLC U.S. Pat. No. 6,553,198 B1 issued Apr. 22, 2003 discloses a plural corona wire scorotron with a single piece mesh control grid formed in plural planar segments forming a curvilinear configuration generally corresponding to the curvature of the drum surface being charged, by stringing thin grid wires into a chevron-shaped grid. It indicates that a U.S. Pat. No. 5,206,784 issued Apr. 27, 1993 to Kimiwada, et al has separate planar grids equally spaced from the cylindrical shaped member.

A specific feature of the specific embodiment disclosed herein is to provide a compact corona charging system for uniformly charging a small radius moving surface, comprising integral independently controllable leading and trailing corona charging sections for sequentially charging said small radius moving surface, said leading corona charging section comprising a first elongated corona discharge member transverse said moving surface connectable to a first high voltage current supply and a first corona screen grid member connectable to first screen grid control voltage supply, said trailing corona charging section comprising a second elongated corona discharge member transverse said moving surface connectable to a second high voltage current supply and a second corona screen grid member connectable to a second screen grid control voltage supply and electrically independent of said first corona screen grid member and said first screen grid control voltage supply, said first corona screen grid member being interposed between said first elongated corona discharge member and said small radius moving surface, and said second corona screen grid member being interposed between said second elongated corona discharge member and said small radius moving surface.

Further specific features disclosed in the embodiment herein, individually or in combination, include those wherein said first and second elongated corona discharge members are multiple pin array members angularly spaced from one another to each be approximately perpendicular to said small radius moving surface; and/or wherein said small radius moving surface has a desired surface charge level from said corona charging system, and said integral independently controllable leading and trailing corona charging sections each partially sequentially charge said small radius moving surface to said desired surface charge level; and/or wherein said small radius moving surface has a desired surface charge level, and said integral independently controllable leading and trailing corona charging sections each partially sequentially charge said small radius moving surface to said desired surface charge level by said first corona screen grid member being biased to a different voltage by said first grid control voltage supply than said second corona screen grid member is biased by said second grid control voltage supply; and/or wherein said small radius moving surface has a desired surface charge level, and said integral independently controllable leading and trailing corona charging sections each partially sequentially charge said small radius moving surface to said desired surface charge level by said leading corona charging system charging said small radius moving surface to less than said desired surface charge level and said trailing corona charging section charging said small radius moving surface to the rest of said desired surface charge level; and/or wherein said small radius moving surface has a desired surface charge level, and said integral independently controllable leading and trailing corona charging sections are adapted to each partially sequentially charge said small radius moving surface to said desired surface charge level by said leading corona charging system charging said small radius moving surface to less than said desired surface charge level and said trailing corona charging section charging said small radius moving surface to the rest of said desired surface charge level by said first corona screen grid member being biased to a different voltage by said first grid control voltage supply than said second corona screen grid member is biased by said second grid control voltage supply, and wherein said first and second corona screen grid members are electrically separate planar members angled relative to one another and angled substantially parallel to the adjacent tangent of said small radius moving surface; and/or a method of non-contact corona charging of a small radius moving surface to a desired surface voltage with a single corona charging system, wherein a first corona charging section of said single corona charging system applies a first corona charge to said small radius moving surface through a first corona screen grid control member having a first applied bias voltage to charge said small radius moving surface to more than half of but less than all of said desired surface voltage, and a second corona charging section of said single corona charging system then applies a second corona charge to said small radius moving surface through a second corona screen grid control member having a second applied bias voltage to charge said small radius moving surface to the remainder of said desired surface voltage; and/or wherein said first and second corona charges are generated by spaced separate pin array corona generators; and/or wherein said first and second corona screen grid control members are electrically separate planar members angled relative to one another and angled substantially parallel to the adjacent tangent of said small radius moving surface.

The disclosed system may be operated and controlled by appropriate operation of conventional control systems. It is well known and preferable to program and execute various xerographic printing and other control functions and logic with software instructions for conventional or general purpose microprocessors, as taught by numerous prior patents and commercial products. Such programming or software may, of course, vary depending on the particular functions, software type, and microprocessor or other computer system utilized, but will be available to, or readily programmable without undue experimentation from, functional descriptions, such as those provided herein, and/or prior knowledge of functions which are conventional, together with general knowledge in the software or computer arts. Alternatively, the disclosed control system or method may utilize or be implemented partially or fully in hardware, using standard logic circuits or single chip VLSI designs.

The term "reproduction apparatus" or "printer" as used herein broadly encompasses various printers, copiers or multifunction machines or systems, xerographic or otherwise, unless otherwise defined in a claim.

As to specific components of the subject apparatus or methods, or alternatives therefor, it will be appreciated that, as is normally the case, some such components are known per se in other apparatus or applications, which may be additionally or alternatively used herein, including those from art cited herein. For example, it will be appreciated by respective engineers and others that many of the particular component mountings, component actuations, or component drive systems illustrated herein are merely exemplary, and that the same novel motions and functions can be provided by many other known or readily available alternatives. All cited references, and their references, are incorporated by reference herein where appropriate for teachings of additional or alternative details, features, and/or technical background. What is well known to those skilled in the art need not be described herein.

Various of the above-mentioned and further features and advantages will be apparent to those skilled in the art from the specific apparatus and its operation or methods described in the example below, and the claims. Thus, they will be better understood from this description of this specific embodiment, including the drawing figures (which are approximately to scale) wherein:

Figure 1:
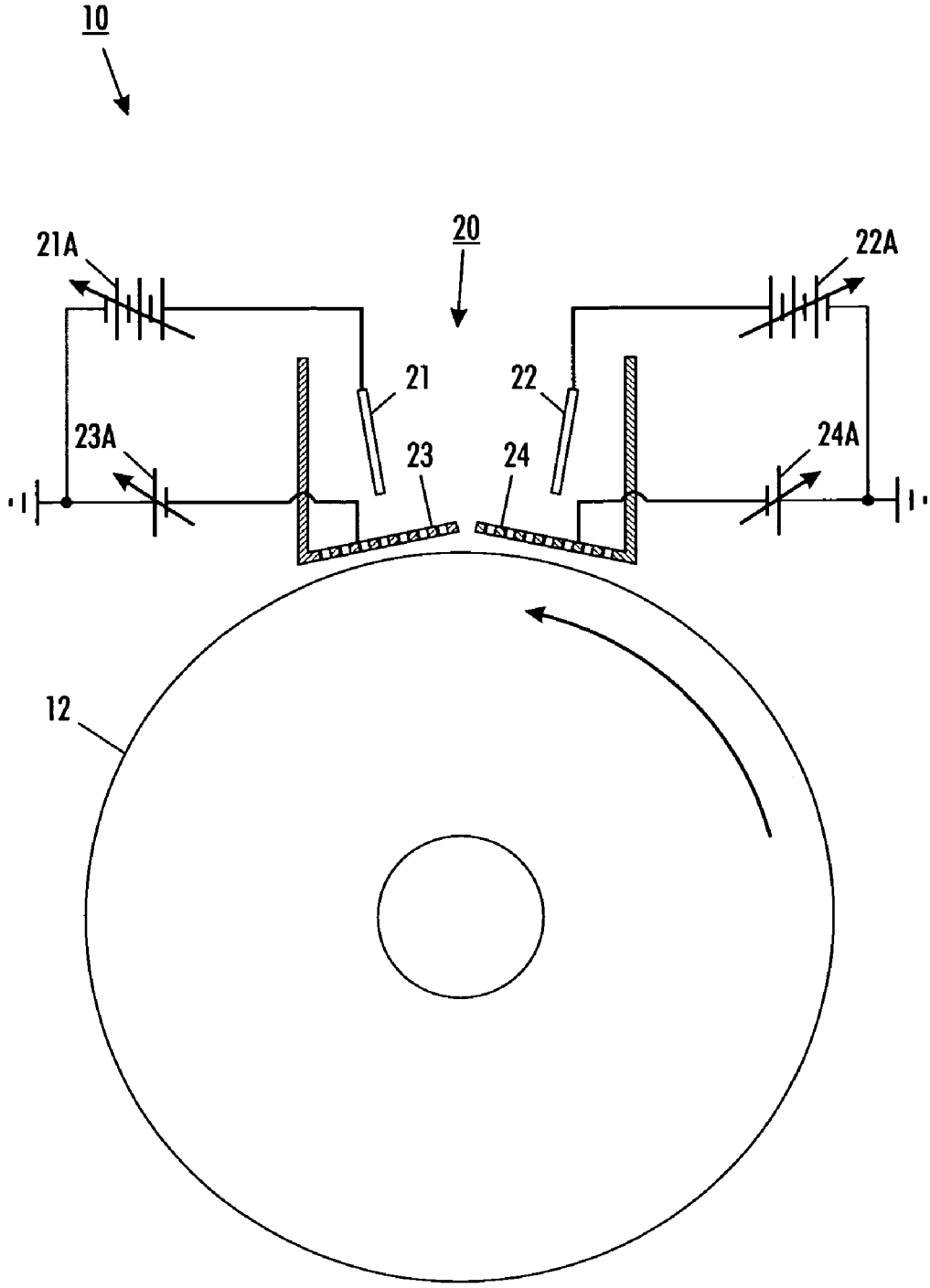
FIG. 1 is a schematic frontal view of an exemplary scorotron corona charging system for charging the surface of a small diameter drum, in this example, a small diameter photoreceptor drum of a conventional xerographic printer.
Figure 2:
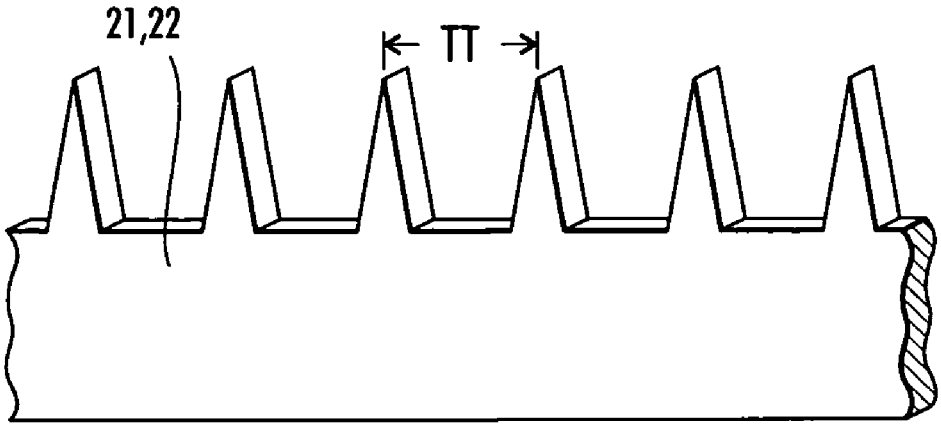
FIG. 2 is an enlarged and inverted view of a small portion of one of the exemplary angled saw-tooth pin corona charging members of the exemplary corona charging system of FIG. 1.

Describing now in further detail the exemplary embodiment with reference to the figures, xerographic printing and corona charging including scorotron charging systems in general, including their theory, functions, etc., are well know in the art, including art cited herein, and need not be redescribed herein. FIG. 1 provides a schematic representation of one example of an improved corona surface charging system 10 for charging a small diameter surface 12 with a compact scorotron 20 which may be substantially conventional other than as described herein. This scorotron 20 has first and second separate and differently angled sawtooth blade pin charging members 21 and 22 (see also FIG. 2, showing an exemplary pin (tooth) spacing TT). The schematically illustrated electrical connections to these pin charging members 21 and 22 for their corona generation are respective separate adjustable high voltage DC current supplies 21A and 22A in this example. The generated electrical corona emissions from the sharp tips of these saw tooth charging members 21 and 22 are respectively controlled by a dual or split screen system of underlying separate and differently angled screen grids 23 and 24 (see also FIG. 3) between the charging members 21 and 22 and the surface 12. These two separate scorotron corona output control screens 23 and 24 have respective separately adjustable control voltage supplies 23A and 24A. This is schematic, and it will be appreciated by those skilled in this art that respective applied currents and voltages for all four said biased conductive elements can be obtained by output taps from the same or partially shared power supplies.

By way of background, the charging of particularly small diameter xerographic imaging drums, such as those of less than 60 mm in diameter, has long been frequently accomplished using contact charging methods, mostly direct contact bias charging rolls, due to their small size and ease of manufacture. However, a major disadvantage of such charge roll technology is the need for high applied AC voltages (for uniform charging) that require power supplies that are more costly than DC voltage sources. The AC voltage can generate excessive reactants, which can degrade the photoreceptor transport layer of the drum, causing physical wearing of the drum surface. This wear can limit the useable life of the photoreceptor drum, which drives up the system run costs. That is especially a problem in some xerographic color printing systems, which may, for example, have four such small diameter photoreceptor drums of only about 30 mm diameter each. Reducing photoreceptor drum replacement rates is highly desirable for both improved run costs and reduced maintenance or replacement intervention rates.

Disclosed in this example is a small footprint (e.g., only about 18 mm wide in total) scorotron charging device 20 using two pin arrays 21 and 22 and two electrically independent grids 23 and 24 to provide a suitable non-contact charging system for various small radius photoreceptor surfaces. This configuration can allow for more optimal voltage uniformity by ramping up the photoreceptor surface 12 voltage in two charging steps. It can also allow for improved control methods to provide more uniform charging over the photoreceptor life. Due to its non-contacting configuration and operation, it can also enable improvement in the wear rate of the charge transport layer of the photoreceptor so that longer drum lives can be achieved.

The exemplary scorotron 20 here consists of two pin arrays 21 and 22 that may be spaced as close as 6 mm apart from each other from charging tip end to charging tip end. Each is preferable angled as shown so that each is approximately perpendicular to a line drawn tangent the photoreceptor surface 12 it faces. These two pin arrays 21 and 22 may be electrically connected to each other, or separately charged as shown by 21A and 22A. As noted below, optimal photoreceptor voltage may be achieved when the applied DC current to the two pin arrays are equal. The two grids 23 and 24 may be positioned perpendicular to each said respective pin array and may be spaced approximately 6 mm away from each pin array charging tip end. The spacing between the grids 23 and 24 and the photoreceptor surface 12 may be approximately 1.5 to 2.0 mm. Each of these grids 23 and 24 are electrically isolated from one other so that an independent DC voltage from 23A and 24A can be applied to each. Side shields may be conventionally positioned on either side of the two pin arrays. They may be spaced approximately 18 mm from each other with the two pin arrays centered between them. Each of the side shields may be electrically connected to their closest grid, as shown in FIG. 1, or not.

As noted, charging voltage non-uniformity on the surface 12 is believed to be minimized when the current applied to each of the pins is equal, regardless of the grid biases or grid to photoreceptor spacing. Further, that uniformity is believed to be improved as the pin current is increased. In one example, assume 8.75 μA of DC current would be applied to each pin. For approximately 110 pins per array and with two pin arrays, a total current of 1925 μA would thus be applied to the pins. Operating the pins at higher current could increase the rate of ozone generation and pin tip degradation without apparently providing added benefit to surface 12 voltage uniformity.

A benefit of the illustrated design is the ability to independently bias the grids 23 and 24 to control the final voltage of the photoreceptor surface 12. Voltage uniformity is believed to be best when the current density from the corona charging device is applied in two steps. The first step (under the leading grid 24 and leading pin array 22 for the counter-clockwise rotation shown for drum surface 12 in this example) may apply enough current density to surface 12 to obtain roughly 80% of the desired final surface voltage. The second step (under the trailing grid 23 and trailing pin array 21 here), may then apply the remaining current density that adds the remaining 20% of the desired final surface voltage and levels out any non-uniformities that may have occurred under the leading grid 24. By independently biasing with adjustable voltage supplies 23A and 24A these two electrically isolated grids 23 and 24, the current density delivered by each half of the scorotron 20 can be controlled to provide the optimal voltage uniformity and desired final surface voltage level.

For example, to achieve a final surface 12 voltage of minus 700 volts, the first grid bias may set to minus 540 volts and the second at minus 690 volts. This is believed to potentially yield a 15-20 percent voltage uniformity improvement over a single grid configuration. The final uniformity can be improved by lowering the grid 24 voltage 24A of the first or lead half 22, 24 of the device to prevent the photoreceptor from reaching the final voltage too quickly. If the surface voltage following this first half of the charging was close to or at the final voltage, any voltage levels exceeding the desired final voltage could not be compensated by the charging done under the second half 21, 23 of the device. That might otherwise require a more costly AC device configuration.

Figure 3:
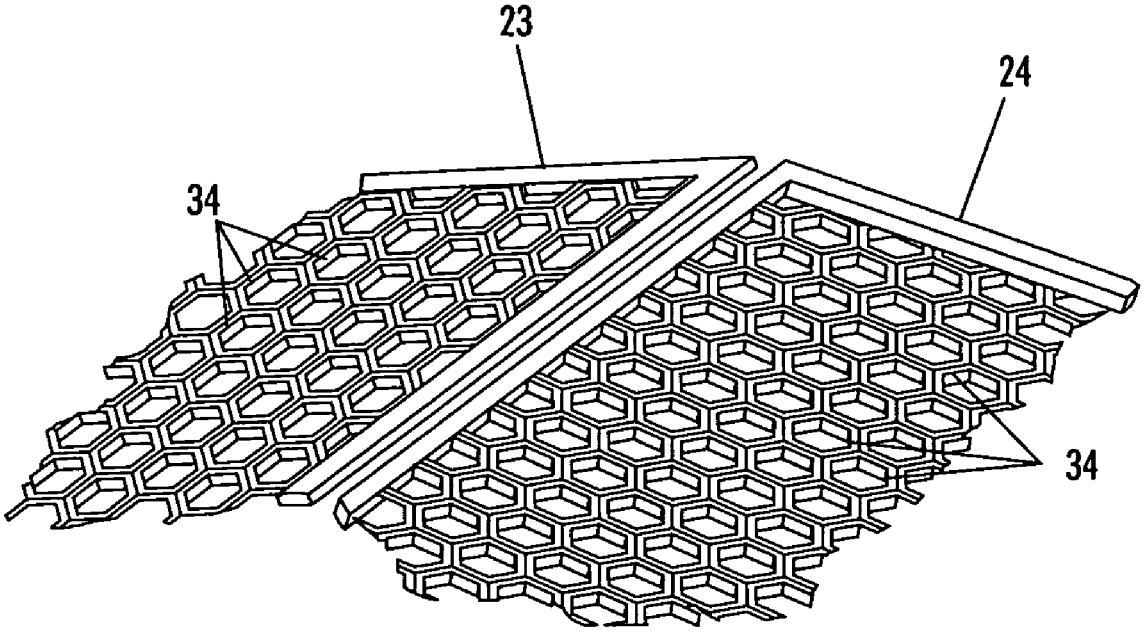
FIG. 3 is enlarged top view of small adjacent portions of the two relatively angled scorotron control grids of the corona charging system of FIG. 1

Another benefit of this proposed design is the reduction in the grid to photoreceptor spacing under the entire device. Because the two separate grids 23, 24 are respectively angled towards the tangent of their respective facing portion of the drum surface, rather than being in the same plane, the grid to photoreceptor spacing is more constant than if a flat grid was spanned across the same total 18 mm width. This can allow for a slight increase in the slope of the current delivered versus the photoreceptor voltage of the device, which may improve its ability to combat dark decay and charge depletion, which in turn may also improves the final voltage uniformity. While a curved grid formed to the exact shape of the photoreceptor would maximize that slope, the manufacturing difficulties and costs associated with achieving a curved grid shape outweigh the small benefit that would be achieved over these substantially planar but slightly differently angled and independently electrically biased grids 23 and 24. FIG. 3 illustrates for both grids 23 and 24 a chemically etched grid pattern 34 with hexagon shaped holes to provide large open areas thereof, although this example is not limited thereto.

In summary, the exemplary scorotron 20 here is a small-footprint pin charging device employing two coronode arrays and a dual corona discharge control grid consisting of two separately angled and independently biased grid segments, particular suited to replace the AC contact charging device (BCR) normally that is used on small diameter (<60 mm) photoreceptor drums, for longer photoreceptor life. It is believed that improved surface charging uniformity can be achieved when the two respective grid biases are adjusted to ensure that the lead current density delivered to the photoreceptor provides 80% or less of the final photoreceptor voltage, in contrast to other dual pin array devices which deliver a constant current density under the entire device. The ability to use different current set points for each pin set, as disclosed in the present example, is believed to be advantageous. Furthermore, both the angle of the two charging pins arrays relative to the drum and the angle of the two grids relative to the drum allows for an overall system width smaller than normal two pin array surface charging devices.

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others.

What is claimed is:

1. A compact corona charging system for uniformly charging a small radius moving photoconductive drum surface, said moving photoconductive drum surface having a diameter up to 60 mm, a scorotron charging device comprising:

a first corona generator, a second corona generator, said scorotron charging device being about 18 mm wide, said first and second corona generators being electrical contact with said drum and being in the form of spaced pin arrays positioned substantially perpendicular to an adjacent moving surface of said drum, said spaced pin arrays being about 6 mm apart from each other, said first corona generator enabled to apply a first charge through a first screen grid having a first bias voltage and enabled to initially surface charge said surface to more than half of a desired voltage, said second corona generator enabled to apply a remainder of said desired surface charge through a separate second screen grid having a second bias voltage, said first and second corona generators being spaced about 6 mm apart, a spacing between said photoconductive drum and said first and second screen grids being about 1.5-2.0 mm; and said first and second screen grids are respectively angled substantially parallel to the adjacent tangent of their respective facing portion of the drum surface.

* * * * *